US006378352B1

(12) United States Patent
Bossard et al.

(10) Patent No.: US 6,378,352 B1
(45) Date of Patent: Apr. 30, 2002

(54) METHOD AND APPARATUS FOR WINDING THIN WALLED TUBING

(76) Inventors: Peter R. Bossard, 33 Oswin Turn, Langhorne, PA (US) 19047; Edward Boling, 460 Emerson St., Fremont, CA (US) 94539

( * ) Notice: Subject to any disclaimer, the term of this patent is extended or adjusted under 35 U.S.C. 154(b) by 0 days.

(21) Appl. No.: 09/702,637

(22) Filed: Nov. 1, 2000

(51) Int. Cl.[7] ..... B21D 26/02

(52) U.S. Cl. ..... 72/370.22; 72/58; 72/135; 72/137; 72/371

(58) Field of Search ..... 72/58, 61, 62, 72/135, 137, 146, 148, 370.01, 370.22, 371

(56) References Cited

U.S. PATENT DOCUMENTS

| | | | | | |
|---|---|---|---|---|---|
| 2,771,934 A | * | 11/1956 | Payne | 72/137 |
| 3,362,061 A | * | 1/1968 | Krasnitz | 72/369 |
| 3,516,433 A | | 6/1970 | Guinot | 137/355.26 |
| 3,685,330 A | * | 8/1972 | Funke | 72/137 |
| 4,424,624 A | | 1/1984 | Sievers | 29/727 |
| 4,735,071 A | | 4/1988 | Ueda et al. | 72/65 |
| 5,129,247 A | * | 7/1992 | Johnson | 72/60 |
| 5,327,764 A | * | 7/1994 | Weykamp et al. | 72/61 |

FOREIGN PATENT DOCUMENTS

| | | | | |
|---|---|---|---|---|
| FR | 2380827 | * | 9/1978 | 72/146 |

* cited by examiner

*Primary Examiner*—Ed Tolan
(74) *Attorney, Agent, or Firm*—LaMorte & Associates

(57) ABSTRACT

A system and method of winding a length of tubing into a coil. The system uses a mandrel to wind a length of tubing into the form of a coil. The length of tubing is both internally pressurized and placed under tension prior to being wound around the mandrel. The tension experienced by the length of tubing causes the tubing to conform to the shape of the mandrel as the mandrel rotates. The internal pressurization of the tubing keeps the diameter of the tubing round as it is deformed around the mandrel. As such, the tubing is prevented from crushing or buckling as it winds around the mandrel.

16 Claims, 2 Drawing Sheets

METHOD AND APPARATUS FOR WINDING THIN WALLED TUBING

REFERENCE TO DOCUMENT DISCLOSURE

The matter of this application corresponds to the matter contained in Disclosure Document 454,147, filed Apr. 1, 1999, wherein this application assumes the priority date of that document.

RELATED APPLICATIONS

This application is related to co-pending patent application Ser. No. 09/702,636, entitled HYDROGEN DIFFUSION CELL ASSEMBLY AND ITS METHOD OF MANUFACTURE.

BACKGROUND OF THE INVENTION

1. Field of the Invention

The present invention relates to systems and methods of winding metal tubing into coils.

2. Description of the Prior Art

There are many different devices that contain coils made from hollow tubing. Such coils are commonplace in refrigerators, air conditioners, dehumidifiers and the like. When manufacturing such coils, a straight piece of metal tubing is connected at one end to a mandrel. The mandrel is then rotated, thereby cause the metal tubing to wind around the mandrel and create the desired coil. Such prior art coil production techniques work well for metal tubing that has thick walls. With such a thick walled tubing, the strength of the tubing itself prevents the tubing from crushing or buckling as it is wound around the mandrel. However, metal tube coils are made of many different materials and with many different wall thicknesses. In many applications, the strength of the tubing itself is insufficient to withstand a traditional winding procedure.

One application of a metal tube coil is described in co-pending patent application Ser. No. 09/702,636, entitled Hydrogen Diffusion Cell Assembly And Its Method Of Manufacture. In such an application, a coil is produced from palladium or a palladium alloy. Furthermore, the tubing is extremely thin walled, having an average wall thickness of between 0.001 inches and 0.005 inches. Such a thin walled tubing cannot be wound into a coil using prior art coil winding techniques. If such a thin walled tube were to be connected to a mandrel and wound in a traditional manner, the forces applied during the winding procedure would crush the tubing flat and/or cause the tubing to buckle.

A need therefore exists for a method and system that can be used to wind very thin walled tubing into coils. The need is met by the present invention as it is described and claimed below.

SUMMARY OF THE INVENTION

The present invention is a system and method of winding a length of tubing into a coil. The system uses a mandrel to wind a length of tubing into the form of a coil. However, prior to winding, the length of tubing is both internally pressurized and placed under tension prior to being wound around the mandrel. The tension experienced by the length of tubing causes the tubing to conform to the shape of the mandrel as the mandrel rotates. The internal pressurization of the tubing keeps the diameter of the tubing round as it is wound around the mandrel. As such, the tubing is prevented from crushing or bulking as it is wound around the mandrel.

The tension force applied to the length of tubing can be either constant or variable, depending upon the winding technique used. A constant tension force is used when the elongation of the length of tubing is left to chance. A variable tension force is used when the elongation of the length of tubing is monitored and controlled.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention system and method can be used to produce coils from most any type of metal tubing, such as copper tubing, stainless steel tubing or the like, the present invention is especially well suited for winding thin walled, special metal tubing into coils. Consequently, by way of example, the present invention will be described in an application where it is used to wind palladium tubing having a wall thickness of only between 0.001 inches and 0.005 inches.

Figure 1:
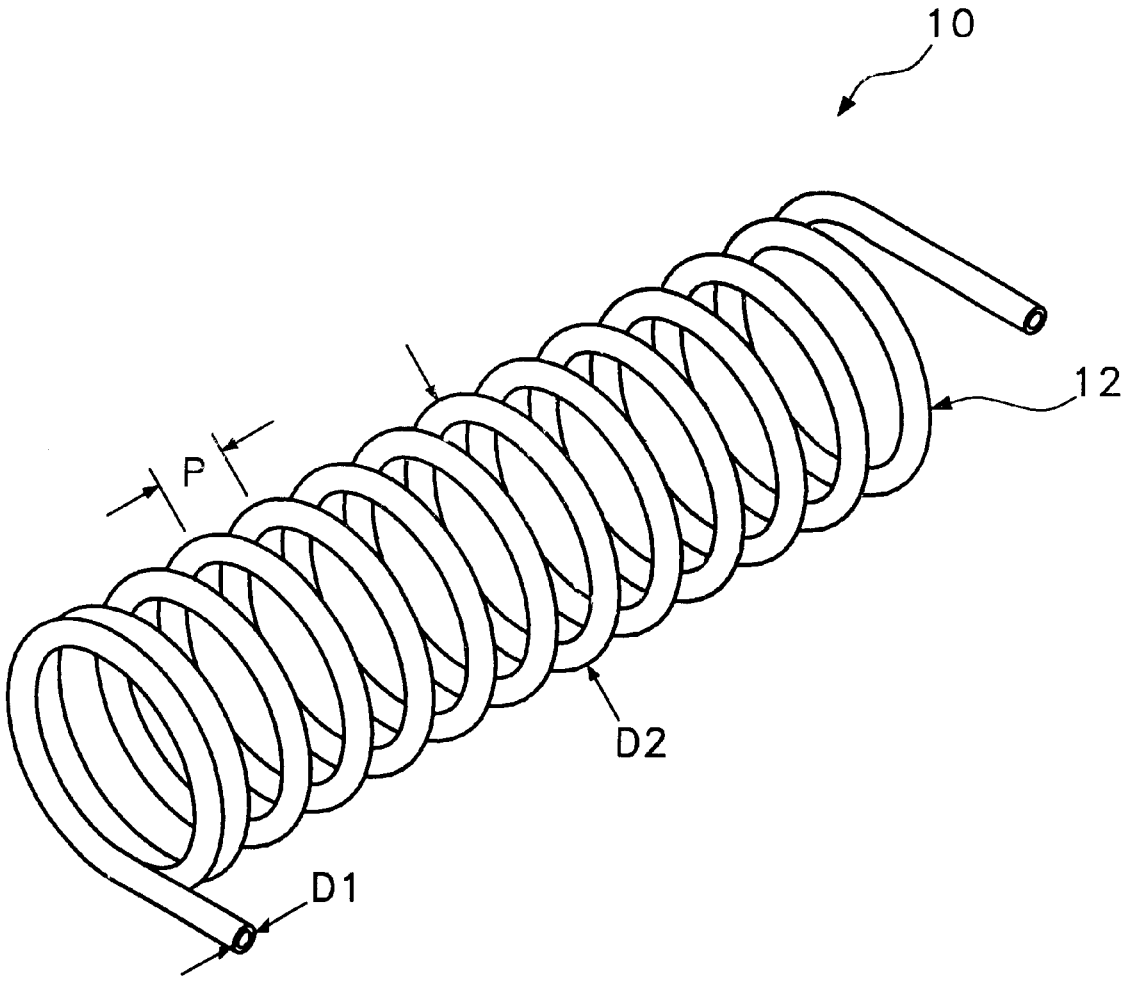
FIG. 1 is a perspective view of a tubing coil made utilizing the present invention system and method.

Referring to FIG. 1, there is shown a coil 10 that has been fabricated using the present invention system and method. The coil 10 is made of metal tubing 12 that has been wound. In the shown embodiment, the metal tubing 12 being used is made of palladium or a palladium alloy. The tubing 12 has a diameter D1 of between 0.1 inches and 0.5 inches. The thickness of the wall of the tubing 12 can be as thin as 0.001 inches. The tubing 12 is wound into a coil having a coil diameter D2 and a winding pitch spacing P1 of at least as long as the diameter D1 of the tubing 12.

Figure 2:
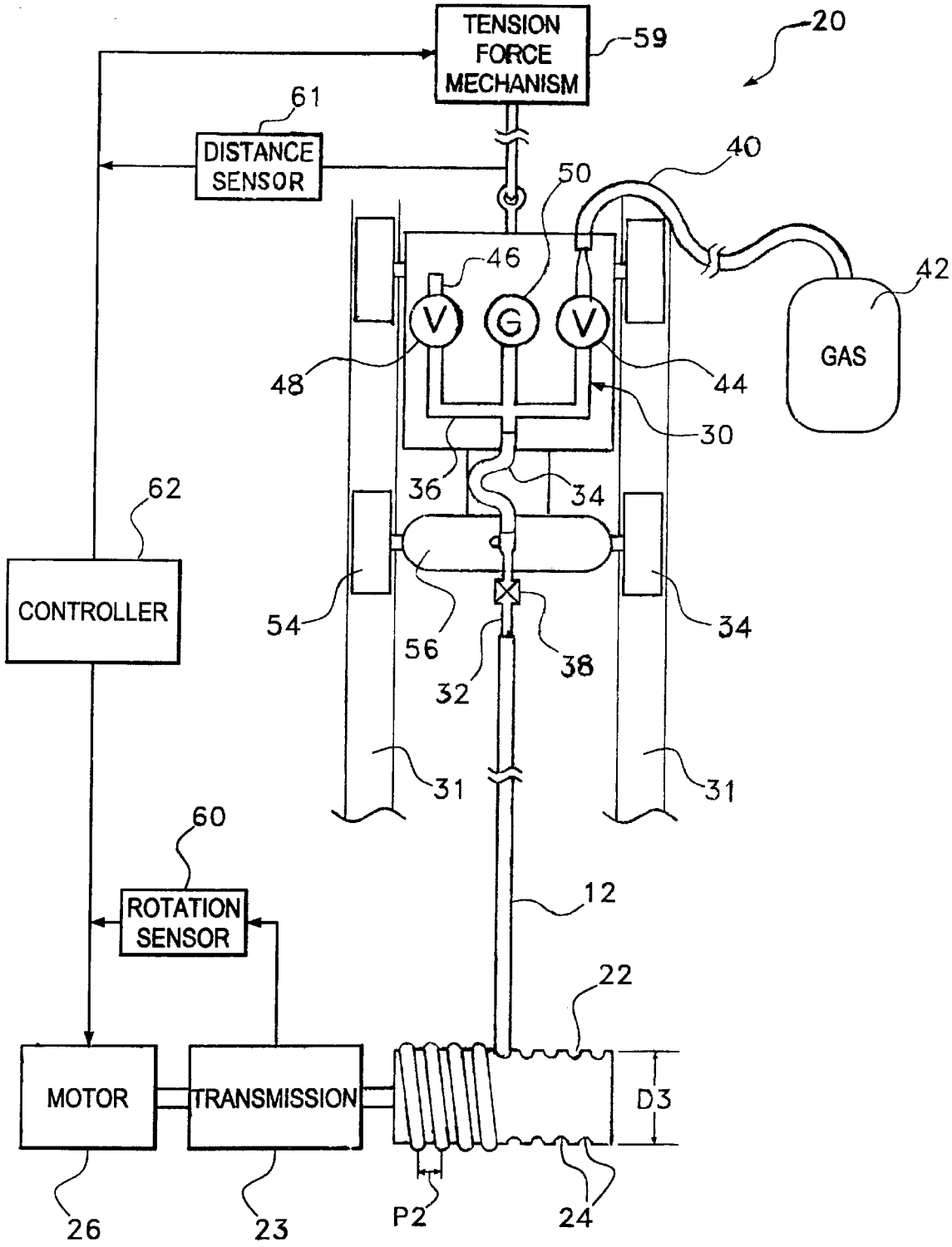
FIG. 2 is a schematic illustrating the present invention system and its method of use.

Referring to FIG. 2, a winding system 20 is shown for use in fabricating the wound coil 12 shown previously in FIG. 1. The winding system 20 contains a winding mandrel 22. The winding mandrel has an outer diameter D3 that corresponds to the coil diameter D2 (FIG. 1) of the coil to be produced. The mandrel 22 has a helical groove 24 formed on its exterior surface. The helical groove 24 has a radius of curvature that corresponds to that of the tubing 12 being wound. The helical groove 24 in the mandrel 22 also has a winding pitch spacing P2 that corresponds to the winding pitch spacing P1 (FIG. 1) of the coil being produced.

The mandrel 22 is turned by a motor 26. An optional transmission 23 may be placed between the motor 26 and the mandrel 22 if the rotational speed of the motor 26 is different from what is practical for the winding procedure. A transmission 23 can also be used if the torque produced by the motor 26 is insufficient to directly wind the tubing 12.

Prior to attaching the tubing 12 to the mandrel 22, the first end of the tubing 12 is soldered closed to create a gas tight seal at the first end of the tubing 12. The first end of the tubing 12 is then connected to the mandrel 22 at the beginning of the helical groove 24. When the tubing 12 is first attached to the mandrel 22, the tubing 12 is straight. The length of the straight section of tubing 12 is made to correspond to the length of tubing needed to complete the coil 10 (FIG. 1).

The second end of the tubing 12 is connected to a wheeled cart assembly 30. The wheeled cart assembly 30 has a front end and a rear end. At the front end of the wheeled cart 30 is a connection nipple 32. The second end of the tubing 12 is soldered or otherwise interconnected to the connection nipple 32. The connection nipple 32 is connected to a flexible hose 34 that leads to a gas supply manifold 36. A gas flow restrictor 38 is positioned between the gas supply manifold 36 and the connection nipple 32 for a purpose which will later be explained.

The gas supply manifold 36 is connected to a supply hose 40 that connects the manifold 36 to a source of compressed gas 42. Although many different types of gas can be used, the preferred gas is compressed nitrogen. A supply valve 44 is disposed between the manifold 36 and the supply hose 40 to selectively control the flow of compressed gas into the manifold 36 from the source of compressed gas 42.

A vent port 46 is also connected to the gas supply manifold 36. A venting valve 48 is disposed between the manifold 36 and the vent port 46 to selectively control the venting of gas from the gas supply manifold 36. A pressure gauge 50 is also connected to the gas supply manifold 36 on the wheeled cart assembly 30. The pressure gauge 50 measures the pressure in the gas supply manifold 36.

When the second end of the tubing 12 is soldered to the connection nipple 32, the interior of the tubing 12 becomes interconnected with the gas supply manifold 36. Accordingly, as the source of compressed gas 42 pressurizes the gas supply manifold 36, the interior of the tubing 12 also becomes pressurized. Consequently, the pressure gauge 50 that measures the pressure within the gas supply manifold 36 also measures the gas pressure that exists inside the tubing 12. The flow restrictor 38 is used as a safety feature to prevent the tubing 12 from whipping around should the tubing 12 ever break or become severed while under pressure.

The pressure supplied to the tubing 12 depends upon the material and wall thickness of the tubing 12. Preferably, the tubing 12 is pressurized to a pressure between one tenth and one half its designed rupture pressure.

The wheels 54 at the front end of the cart assembly 30 are attached to a front axle assembly 56 that is free to pivot. As a result, as the tubing 12 is wound along the length of the mandrel 22, the wheeled cart assembly 30 can turn laterally and track along the length of the mandrel 22 with the advancing tubing 12. Although not required, the tracking of the wheeled cart assembly 30 can be improved by providing a set of tracks 31 on which the wheeled cart assembly 30 rides. The tracks 31 guide the wheeled cart assembly 30 so that the wheeled cart assembly 30 is always at the proper position with respect to the mandrel 22 as the tubing 12 is wound.

The wheeled cart assembly 30 is free rolling and supplies only limited resistance to the rotating mandrel 22. To keep the tubing 12 taut during winding, a tether 58 is attached to the rear end of the wheeled cart assembly 30. The tether 58 supplies the wheeled cart assembly 30 with an resistance force F that opposes the rotational pull of the mandrel 22. The resistance force F supplied through the tether 58 is created by a tension force mechanism 59. The tension force mechanism 59 be a series of weights and pulleys, a clutched motor, a variable inclined plane or any other mechanism capable of providing a resistance to a tether under tension. The magnitude of the resistance force is dependent upon the characteristics of the tubing 12 being wound.

To operate the present invention system 20, a segment of straight tubing 12 is supplied. The first end of the tubing 12 is sealed and is attached to the mandrel 22. The opposite end of the tubing 12 is soldered to the connection nipple 32 on the wheeled cart assembly 30. An appropriate resistance force F is applied to the tether 58 at the end of the wheeled cart assembly 30. The resistance force F is thus experienced by the tubing 12. The tension in the tubing 12 keeps the tubing 12 straight and causes the tubing 12 to conform to the helical groove 24 in the mandrel 22 as the mandrel 22 is wound.

Prior to winding the tubing 12 around the mandrel 22, the supply valve 44 is opened on the wheeled cart assembly 30. The supply valve 44 connects the pressurized gas source 42 to the connection nipple 32 through the supply manifold 36. The pressurized gas in the supply manifold 36 fills the inside of the tubing 12. The pressure of the gas is brought to a predetermined level as measured by the pressure gauge 50 on the wheeled cart assembly 30.

Once the tubing 12 is pressurized and is under tension, the mandrel 22 is rotated. The tension experienced by the tubing 12 causes the tubing 12 to conform to the helical groove 24 on the mandrel 22. The pressure within the tubing 12 causes the tubing 12 to maintain its round cross-section while it is deformed around the mandrel 22. As such, the tubing 12 does not crush or buckle as it is deformed into a coil.

Once the tubing 12 is fully wound around the mandrel 22, the supply valve 44 on the wheeled cart assembly 30 is closed and the tension of the tether 58 is released. The pressurized gas within the wound tubing 12 is then released by opening the venting valve 48 on the wheeled cart assembly 30. The two ends of the wound tubing 12 are then freed and the wound tubing 12 is removed from the mandrel 22.

The described method of operation can be varied in two ways. In a first technique, the resistance force F applied to the tether 58 by the tension force mechanism 59 can be kept constant. In a second technique, the resistance force F applied to the tether 58 by the tension force mechanism 59 is varied.

As the tubing 12 is placed in tension between the mandrel 22 and the wheeled cart assembly 30, the tubing elongates. Using the first technique of constant tension, the resistance force F supplied by the tension force mechanism 59 is calibrated to be just slightly greater than what is needed to cause the tubing 12 to conform to the helical groove 24 in the mandrel 22. Under these conditions the degree to which the tubing 12 stretches is dependent upon the wall thickness of the tubing 12 and the annealing of the tubing 12. The wall thickness and annealing of the tubing 12 vary along the length of the tubing 12. As such, the tube does not stretch evenly. The result is that different sections of tubing 12 may increase in length by between one percent and six percent. The variability in elongation also corresponds to variability of wall thickness causes by the elongation. The result is a wound coil hat has thin spots at different points in the tubing 12.

A second technique used when winding the tubing 12 is to vary the tension force F as a function of tube elongation. To utilize this technique, a rotation sensor 60 is attached to the mandrel 22, the mandrel motor 26 or the transmission 23 between the motor 26 and the mandrel 22. The rotation sensor 60 detects the number of degrees the mandrel 22 has turned in a given period of time. Furthermore, a distance sensor 61 is coupled either to the wheeled cart assembly 30 or the tether 58 extending to the wheeled cart assembly 30. The distance sensor 61 detects how far the wheeled cart assembly 30 has moved in a given period of time.

The rotation sensor 60 and the distance sensor 61 are both coupled to a controller 62. The controller 62 controls the tension force mechanism 59. The controller 62 varies the tension force mechanism so that the amount of tubing 12 wound on the mandrel 22 in a predetermined period of time corresponds to a predetermined degree of movement of the wheeled cart assembly 30 in that same predetermined period of time. The result is that the degree of elongation experienced by the tubing 12 is kept relatively constant along its entire length.

There are many variations to the present invention system and method that can made. For instance, the wheeled cart assembly 30 can be substituted with a sled, a tracked vehicle or any other assembly capable of linear movement. Furthermore, there are many different types of gas supply manifolds that can be used and there are many different connectors that can be used to connect the tubing 12 to the supply manifold 36. It will therefore be understood that a person skilled in the art can make numerous alterations and modifications to the shown embodiment utilizing functionally equivalent components to those shown and described. All such modifications are intended to be included within the scope of the present invention as defined by the appended claims.

What is claimed is:

1. A method of creating a coil from a length of tubing, comprising the steps of:

connecting one end of the length of tubing to a mandrel;

applying a tension to the length of tubing that biases the tubing away from the mandrel;

internally pressurizing said length of tubing;

rotating said mandrel, wherein the length of tubing winds around the mandrel and forms a coil;

monitoring the rotation of said mandrel in a period of time;

monitoring the movement of said length of tubing toward said mandrel in said period of time; and varying said predetermined tension force as a function of the rotation of said mandrel and the movement of said length of tubing.

2. The method according to claim 1, wherein said mandrel has a helical groove formed thereon and the length of tubing conforms to the helical groove when wound around the mandrel.

3. The method according to claim 1, wherein said step of applying a tension to the length of tubing includes the substeps of:

providing a cart;

attaching one end of the length of tubing to the cart;

biasing the cart away from the mandrel with a predetermined tension force.

4. The method according to claim 3, wherein said substep of biasing the cart includes attaching a tether to the cart and applying said tension force to said tether.

5. The method according to claim 1, wherein said step of internally pressurizing the length of tubing includes connecting the length of tubing to a pressurized gas source.

6. The method according to claim 3, wherein said cart supports a supply manifold coupled to a pressurized gas source.

7. The method according to claim 1, further including the step of venting pressure from the tubing after the length of tubing is wound around the mandrel.

8. The method according to claim 1, wherein said tubing is made from a material selected from a group consisting of palladium and palladium alloys.

9. The method according to claim 1, wherein the length of tubing has a predetermined rupture pressure and the length of tubing is internally pressurized to a pressure between one tenth and one half said predetermined rupture pressure.

10. A system for forming a length of tubing into a coil, comprising:

a selectively rotatable mandrel capable of engaging a first end of the length of tubing;

a supply manifold having a supply valve, a vent valve and a connection port, wherein the connection port is connectable to a second end of the length of tubing;

a cart for supporting said supply manifold;

a tensioning mechanism for biasing said cart away from said mandrel with a tension force, wherein said tubing experiences elongation under said tension force and said tensioning mechanism selectively varies said tension force as a function of said elongation; and a source of compressed gas connected to said supply manifold, wherein said source of compressed gas can be selectively interconnected with the length of tubing via said supply valve.

11. The system according to claim 10, wherein said mandrel has a helical groove formed thereon, whereby the length of tubing follows the helical groove when wound around said mandrel.

12. A method of winding tubing into a coil, comprising the steps of:

pressurizing the interior of a length of tubing to a predetermined pressure above ambient pressure;

winding the length of tubing around a mandrel while the length of tubing is pressurized;

applying a tensioning force to said length of tubing as it wound around said mandrel, wherein said tensioning force creates elongation in said length of tubing;

monitoring the rotation of said mandrel in a period of time;

monitoring said elongation in said length of tubing in said period of time;

varying said tensioning force as a function of the rotation of said mandrel and said elongation;

venting the tubing to ambient pressure; and removing the wound tubing from the mandrel.

13. The method according to claim 12, wherein said mandrel has a helical groove formed thereon and the length of tubing conforms to the helical groove when wound around the mandrel.

14. The method according to claim 12, wherein said step of applying a tension force to the length of tubing includes the substeps of:

providing a cart;

attaching one end of the length of tubing to the cart;

biasing the cart away from the mandrel with a said tensioning force.

15. The method according to claim 13, wherein said substep of biasing the cart includes attaching a tether to the cart and applying said tensioning force to said tether.

16. The method according to claim 13, wherein said step of pressurizing the length of tubing includes connecting the length of tubing to a pressurized gas source.

* * * * *